US006647553B2

(12) United States Patent
Hoyez

(10) Patent No.: US 6,647,553 B2
(45) Date of Patent: Nov. 18, 2003

(54) CAP WITH OPENING IN FRONT

(76) Inventor: Lauren Hoyez, 14919 SW. Summerview Dr., Tigard, OR (US) 97224

( * ) Notice: Subject to any disclaimer, the term of this patent is extended or adjusted under 35 U.S.C. 154(b) by 0 days.

(21) Appl. No.: 10/116,976

(22) Filed: Apr. 4, 2002

(65) Prior Publication Data

US 2002/0162157 A1 Nov. 7, 2002

Related U.S. Application Data

(63) Continuation-in-part of application No. 09/963,476, filed on Sep. 13, 2001, which is a continuation of application No. 08/964,076, filed on Nov. 3, 1997, now abandoned, which is a continuation-in-part of application No. 08/600,344, filed on Feb. 13, 1996, now abandoned.

(51) Int. Cl.[7] ..... A42B 1/06
(52) U.S. Cl. ..... 2/209.12; 2/195.1
(58) Field of Search ..... 2/171, 171.1, 171.3, 2/171.4, 171.5, 181, 181.2, 181.6, 182.1, 182.2, 182.3, 182.8, 183, 184.5, 209.12, 209.3, 209.5, 209.7, 12, 425, 195.1, 195.2, 195.3, 195.4, 195.5, 918

(56) References Cited

U.S. PATENT DOCUMENTS

| | | | | | |
|---|---|---|---|---|---|
| 1,445,451 | A | * | 2/1923 | Rosenweig | 24/594.11 |
| 1,503,007 | A | * | 7/1924 | Rosenzeweig | 2/195.2 |
| 1,748,375 | A | * | 2/1930 | Wittcoff | 2/182.1 |
| 1,996,254 | A | * | 4/1935 | Parlow | 2/209.7 |
| 2,136,039 | A | | 11/1938 | Clancy | |
| 2,156,251 | A | * | 4/1939 | Carlson | 2/175.1 |
| 2,389,689 | A | * | 11/1945 | Scheppler | 2/181.2 |
| 2,393,286 | A | * | 1/1946 | Brunner | 2/209.13 |
| 2,446,053 | A | * | 7/1948 | Matarazzo | 2/195.4 |
| 2,864,383 | A | | 12/1958 | Jacks et al. | |
| 3,214,769 | A | | 11/1965 | Randolph | |
| 4,096,589 | A | * | 6/1978 | Goldstein | 2/12 |
| 4,114,201 | A | * | 9/1978 | Garrison | 2/209.7 |
| 4,131,953 | A | * | 1/1979 | Kimotsuki | 2/171.1 |
| 4,317,238 | A | * | 3/1982 | Amin | 2/12 |
| 4,550,445 | A | | 11/1985 | Fender | |
| 4,864,662 | A | * | 9/1989 | Frank | 2/183 |
| 5,070,545 | A | * | 12/1991 | Tapia | 40/329 |
| 5,170,509 | A | | 12/1992 | Leopold | |
| 5,197,150 | A | * | 3/1993 | Bedient | 2/10 |
| 5,253,364 | A | * | 10/1993 | Robinson | 2/10 |
| 5,321,854 | A | | 6/1994 | Kronenberger | |
| D350,427 | S | | 9/1994 | Vig et al. | |
| 5,437,062 | A | * | 8/1995 | Douglas | 2/195.1 |
| 5,495,622 | A | * | 3/1996 | Kaufman | 2/175.1 |
| 5,509,145 | A | | 4/1996 | Stevenson et al. | |
| 5,613,246 | A | * | 3/1997 | Alexander | 2/10 |
| 5,644,799 | A | * | 7/1997 | Armenta et al. | 2/209.13 |
| 5,734,993 | A | * | 4/1998 | D'Oca | 2/175.3 |
| 5,799,334 | A | * | 9/1998 | Griffith et al. | 2/195.1 |
| 5,907,871 | A | * | 6/1999 | Austin | 2/209.12 |
| 5,933,872 | A | * | 8/1999 | Lema | 2/209.7 |
| 6,081,933 | A | * | 7/2000 | Partsch, IV | 2/422 |
| 6,088,837 | A | * | 7/2000 | Baker | 2/195.1 |
| 6,094,749 | A | * | 8/2000 | Proctor | 2/195.2 |
| 6,367,084 | B1 | * | 4/2002 | Keast | 2/182.7 |
| 6,473,907 | B1 | * | 11/2002 | Harwood | 2/209.13 |
| 6,557,180 | B2 | * | 5/2003 | Hall McKenzie | 2/195.1 |

* cited by examiner

*Primary Examiner*—John J. Calvert
*Assistant Examiner*—Alissa Hoey
(74) *Attorney, Agent, or Firm*—Kolisch Hartwell, P.C.

(57) ABSTRACT

A cap includes a crown defining an opening for receiving the head of a wearer, a brim joined to the crown defining the front thereof, and an aperture on the crown adjacent the brim for allowing an accumulation of hair to extend therethrough. The brim is positioned for providing shade for the wearer's face and the aperture is positioned adjacent the brim for allowing an accumulation of hair to extend therethrough and be deflected by the brim. A reinforced border region of the crown ensures that the cap will assume a desired position while worn by a wearer. The brim may be fastened to the crown rearward of the aperture in such a way to allow relative movement between the crown and the brim. The cap may also be constructed so that the brim is removably fastened to the crown.

3 Claims, 4 Drawing Sheets

CAP WITH OPENING IN FRONT

CROSS-REFERENCE TO RELATED APPLICATION

This application is a continuation-in-part of U.S. patent application Ser. No. 09/963,476, filed Sep. 13, 2001, which is a continuation of U.S. patent application Ser. No. 08/964,076, filed Nov. 3, 1997 now abandoned which is a continuation-in-part of U.S. patent application Ser. No. 08/600,344, filed Feb. 13, 1996 now abandoned, both of which are hereby incorporated by reference.

BACKGROUND AND SUMMARY OF THE INVENTION

This invention relates generally to caps for wearing on a head, and more particularly it concerns a brimmed cap provided with an opening in or near the front for contemporaneously providing shade for a wearer's eyes and face, and allowing an accumulation of the wearer's bangs to extend through the opening.

Hats provided with openings for allowing a wearer's hair to extend therethrough are known. For example, U.S. Pat. No. 5,321,854 to Kronenberger discloses a head wear piece in the form of a baseball hat which has a bill joined to a crown configured to accommodate the head of a wearer. When in place on a wearer's head, the bill faces forwardly and an opening in the back of the hat is provided for allowing an accumulation of hair to pass therethrough and extend in a pony-tail fashion.

While Kronenberger attempts to solve the problem of enabling an individual with an accumulation of hair to wear a baseball hat, the attempt falls short of providing a truly versatile hat because Kronenberger is only concerned with allowing a wearer to extend their hair rearwardly of the hat. That is, a wearer of Kronenberger's hat would only be able to extend the hair on or near the rear part of their head through the opening provided therein. A person with an accumulation of front bangs would find Kronenberger's hat awkward to wear because they would have to either tuck their bangs up under the front of the cap (which may be hot and uncomfortable), part their bangs on either side of the front of the cap (which would not necessarily keep their bangs out of their eyes), or crush/flatten the bangs down upon the forehead which would not only be uncomfortable, but would cause the forehead to sweat and leave a crease across the bangs when the hat was removed. Additionally, a person who desires to ventilate the front portion of their head for the purpose of remaining cool would be unable to do so with Kronenberger's hat. Furthermore, Kronenberger's hat does not shade a wearer's face and eyes and contemporaneously deflect their front bangs.

With the above shortcomings in mind, it is a general object of the present invention to provide a cap for wearing with an aperture allowing a wearer to extend their front bangs therethrough.

It is another object to provide a brimmed cap with an aperture for allowing a wearer to extend their front bangs therethrough, wherein the aperture is positioned so that the brim shields or protects a wearer from the sun, and contemporaneously deflects the wearer's bangs from around their face.

It is another object to provide a sports cap which provides an individual who is taking part in sporting events with increased visibility by shielding their eyes from sunlight and keeping their hair out of their eyes.

It is yet another object to provide a cap which is comfortable and stylish to wear, and simple and inexpensive to manufacture.

The invention achieves these and other objects in the form of a cap which includes a crown defining an opening for receiving the head of a wearer, a brim having an edge which is connected to the crown, and an aperture in the crown adjacent the brim for allowing an accumulation of the wearer's hair to extend therethrough and be deflected, while contemporaneously providing shade for the wearer's face.

These and additional objects and advantages of the present invention will be more readily understood after a consideration of the drawings and the detailed description of the preferred embodiment.

DETAILED DESCRIPTION OF THE PREFERRED EMBODIMENTS OF THE INVENTION

Figure 1:
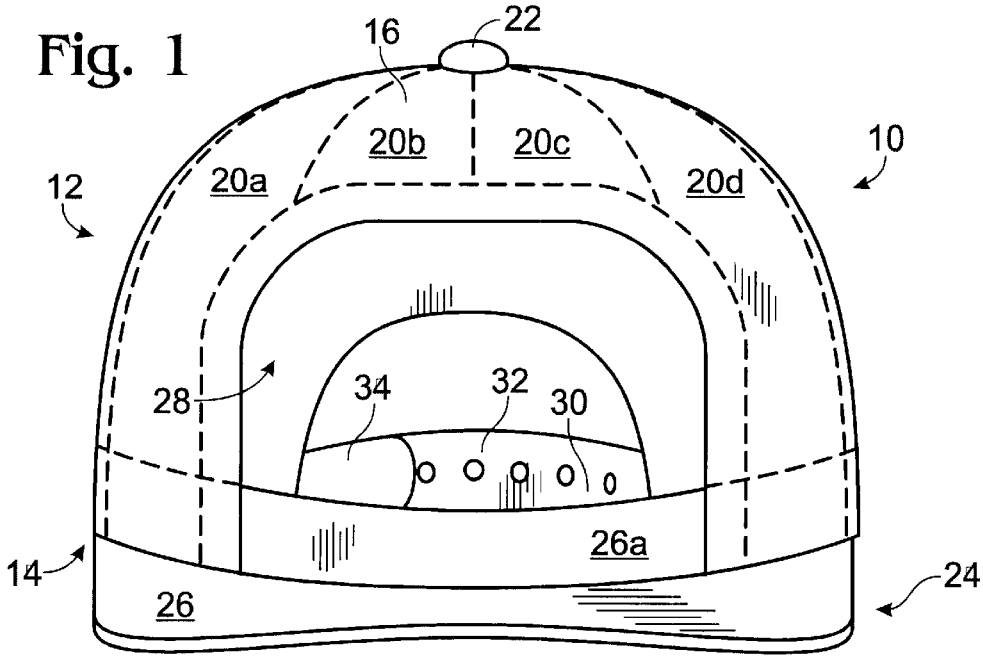
FIG. 1 is a front elevation of a cap constructed according to one embodiment of the present invention.
Figure 2:
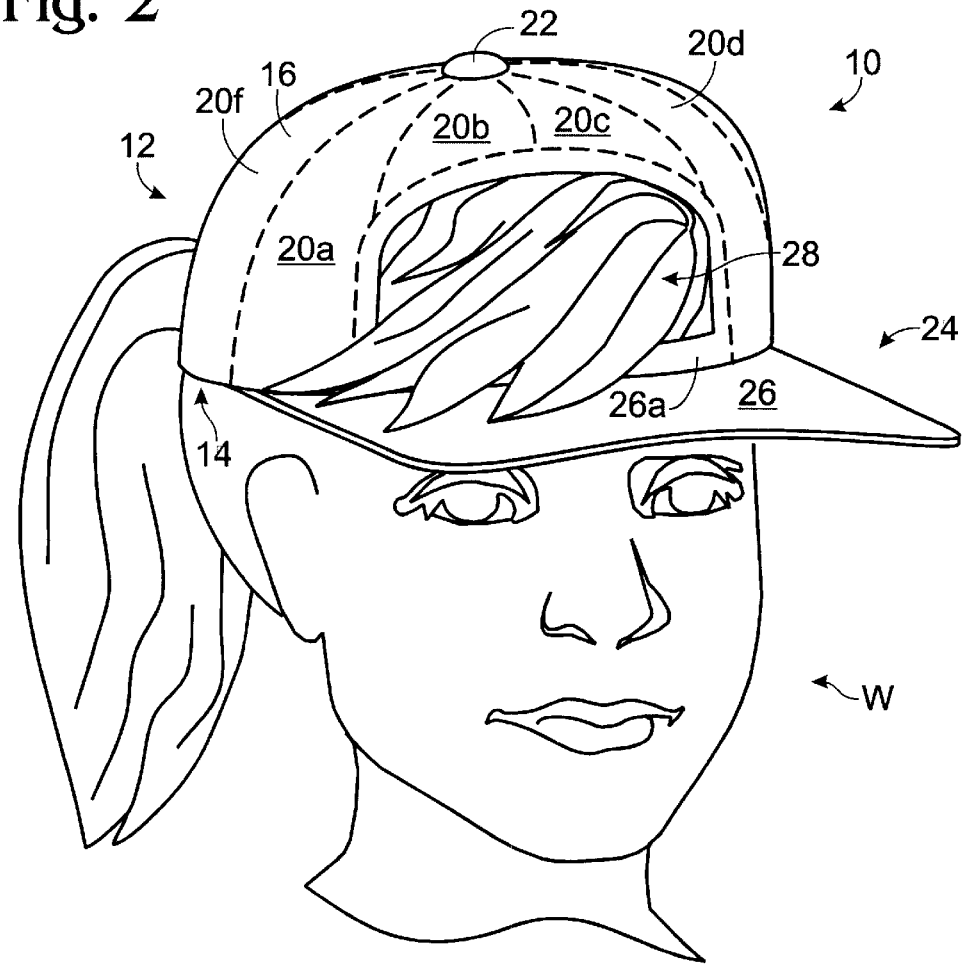
FIG. 2 is an isometric view of the cap constructed according to the preferred embodiment of the present invention, shown in place on the head of a wearer W.
Figure 3:
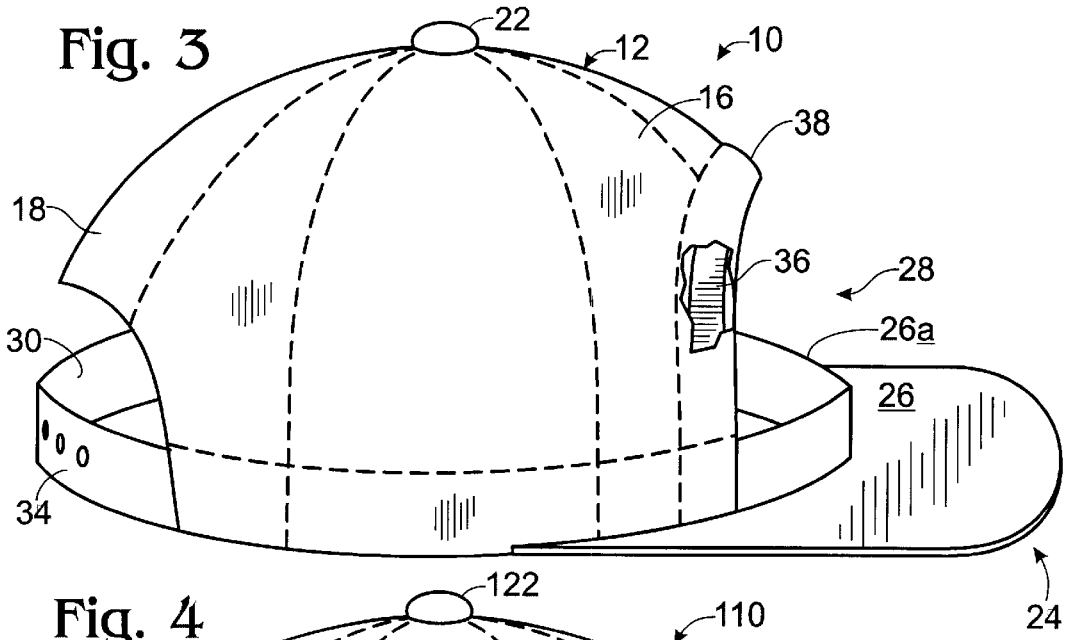
FIG. 3 is a side elevation of the cap shown in FIGS. 1–2.

Referring now to the drawings, and specifically to FIGS. 1–3, a cap or hat is shown generally at 10 being constructed according to the first preferred embodiment of the present invention. For reasons to be described below, cap 10 is preferably a baseball-style sports hat and is useful for wearer W (see FIG. 2) who participates in outdoor sports such as golf and tennis. It will be understood, however, that while cap 10 is described in the context of sports settings, the cap derives utility in many other sports and non-sports settings which will also be evident from the description below.

As shown in FIGS. 1–3, cap 10 includes a head-covering section or crown 12 defining a generally circular opening 14 for receiving the head of a wearer W. Crown 12 includes a front 16 (FIG. 1) and a back 18 (FIG. 3), and is preferably a dome-like structure formed from a plurality of panels, such as those representative ones shown at 20*a* through 20*d* in FIG. 1. The panels are joined or connected together, such as by suitable stitching, in a side-by-side fashion and each panel includes a bottom edge, the collective edges defining, in part, opening 14. Preferably, the panels are generally triangularly-shape so that when they are joined together in side-by-side fashion, the apexes of each triangle converge to define the top of cap 10 where a suitable button 22 anchors the panel apexes or tips together. It will be appreciated, however, that the panels may be any suitable shape, and even more generally, they may be eliminated all together in favor of a generally integrally-formed dome-like structure. In the first preferred embodiment, the panels are formed from any suitable fabric material from which baseball-style caps are usually formed, such materials being readily apparent to those of skill in the art. Additionally, the panels may or may not be formed from the same type of fabric material. For example, panels of varying fabric type would provide a unique and changing-textured surface which might be desirable for certain wearers. Additionally, panels may be formed from different types of material such as plastic webbed material or mesh for providing not only a lightweight construction but increasing the cap's ventilation.

Preferably, cap 10 includes a conventional visor or brim section 24 having an edge 26, a portion of which is joined or connected to crown 12 adjacent the crown's front bottom edge, such as by stitching. It will be appreciated, however, that any suitable manner of joining or connecting the brim will suffice. As shown in FIG. 3, brim section (or brim) 24 extends from edge 26, forwardly of crown 12 and defines the front of the cap. An upstanding lip 26*a* extends generally upwardly from edge 26 and stabilizes the cap, as well as supporting wearer W's front bangs as will become evident below. It will be understood, however, that brim 24 may extend further around the cap than is shown, and may, for example, extend completely around the cap for contemporaneously shading the wearer's eyes, ears, and neck.

An aperture 28 is provided in the front of crown 12 near, and preferably adjacent brim 24 for allowing an accumulation of a wearer's hair, and more specifically a wearer's front bangs, to extend therethrough for a purpose which is described in more detail below. In the first preferred embodiment, aperture 28 is elongate, and one of the long sides thereof extends generally along a substantial length of brim 24, the aperture being sized and configured to allow an accumulation of hair, e.g. the wearer's front bangs, to extend therethrough. The aperture may be any suitable shape such as circular, triangular, rectangular, star-shaped, or any other desirable shape dimensioned for allowing wearer W's front bangs to extend therethrough. However, in the first preferred embodiment the aperture assumes the shape shown, which might be characterized as being defined by a generally flat side (corresponding to that portion of the aperture which lies adjacent brim 24), and a generally arcuate side connected to the ends of the flat side, and spaced therefrom in a direction away from brim 24.

In the first preferred embodiment, aperture 28 is formed by portions of panels 20*a–d* which have been removed. Such removed portions may either be removed after the cap's panels have been joined together, or before the panels are joined together. That is, the panels may be first joined together, and then have a portion cut away to form the aperture, or portions of panels 20*a–d* may be specifically formed with corresponding portions removed for defining the aperture.

FIGS. 1 and 2 show an adjustable member 30 in the form of a standard two-part mated strap which includes a portion 32 having plural apertures therein (FIG. 1), and a portion 34 having a plurality of tangs (FIG. 3) positioned for detachably engaging the apertures for varying the size of opening 14 so that wearer's having different-sized heads may enjoy the cap. Member 30 is visible in FIG. 1 through aperture 28 in crown 12. It will be appreciated that any suitable adjustable member which enables the size of opening 14 to be adjusted will suffice.

Figure 4:
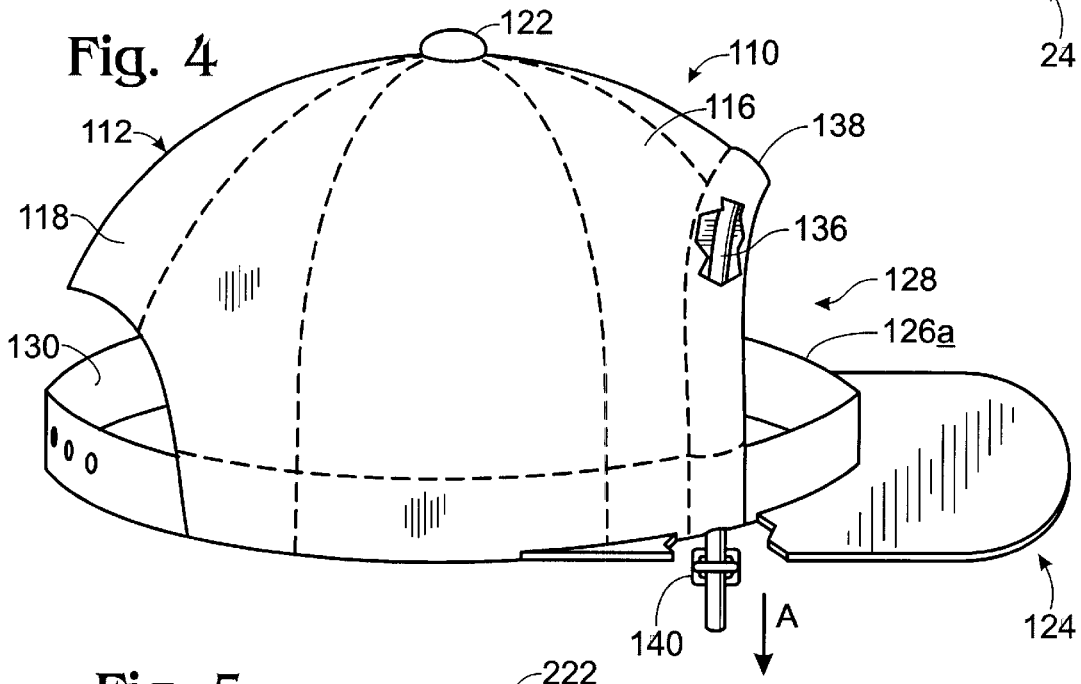
FIG. 4 is a side elevation showing a second embodiment of the cap of the present invention.
Figure 5:
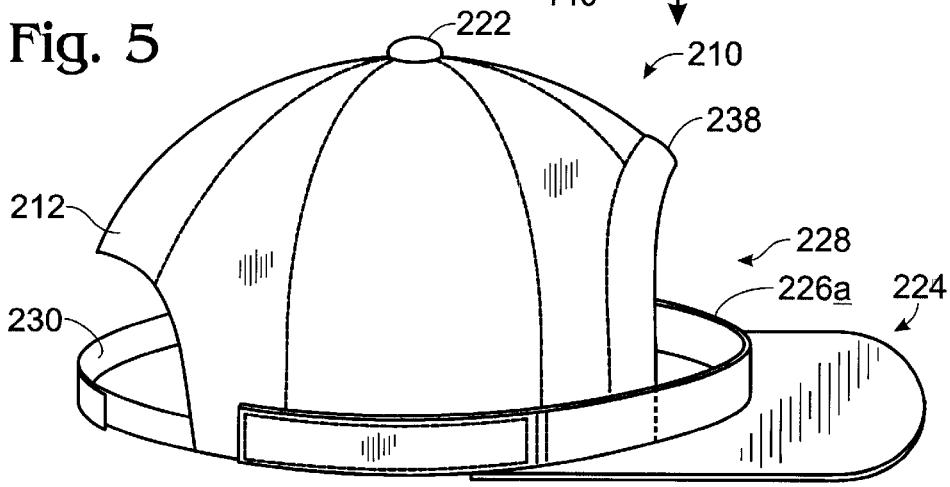
FIG. 5 is a side elevation showing a third embodiment of the cap of the present invention.

Referring to FIGS. 3–4, hat 10 or 110 show alternate embodiments of a section of the hat that reinforces the brim adjacent opening 28, 128. In FIG. 3, hat 10 includes a reinforcement material 36 such as a tensioning element which takes the form of an elastic band sewn into a suitable border 38 adjacent aperture 28. In FIG. 4, hat 110 includes a reinforcement material 136 which takes the form of another tensioning element, a drawstring which can be cinched down in the direction of arrow A. The drawstring is sewn into a suitable border 138 adjacent aperture 128. A suitable cinching element 140 is fastened to hat 220 (undepicted) adjacent brim 224. The idea is to allow the wearer to pull down on the drawstring until a desired tension is placed along border 138. Referring generally to FIGS. 3–4, tensioning of the hat along the aperture border defined by border 38 and 138 has been found to improve the look of the hat when it is worn. That tensioning tends to ensure that the hat will assume a look similar to a hat without aperture 28 or 128.

Figure 6:
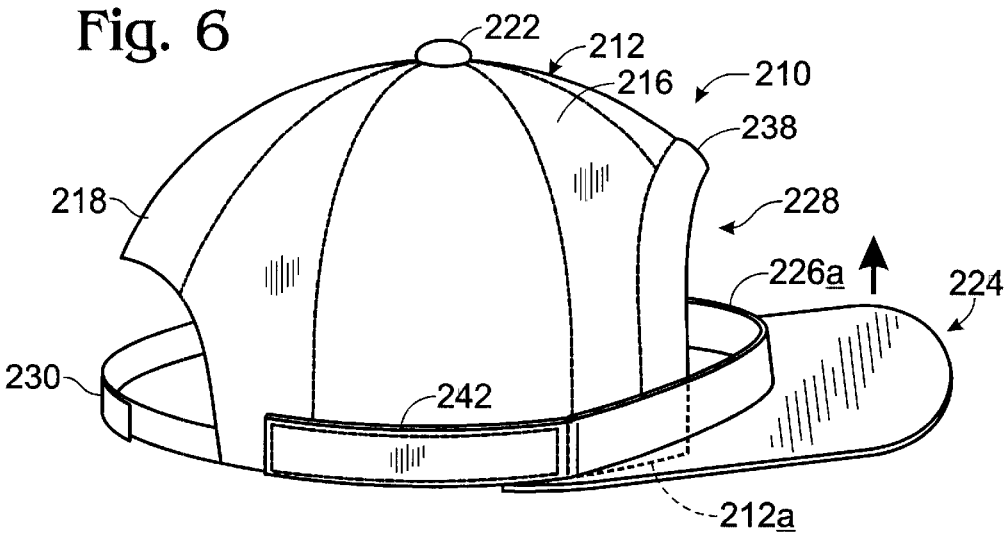
FIGS. 6–7 are side elevational views like that of the third embodiment shown in FIG. 5, except that each figure shows how the visor or brim section of the cap is movable bidirectionally vertically via the novel attachment location of the head-covering section relative to the visor.
Figure 7:
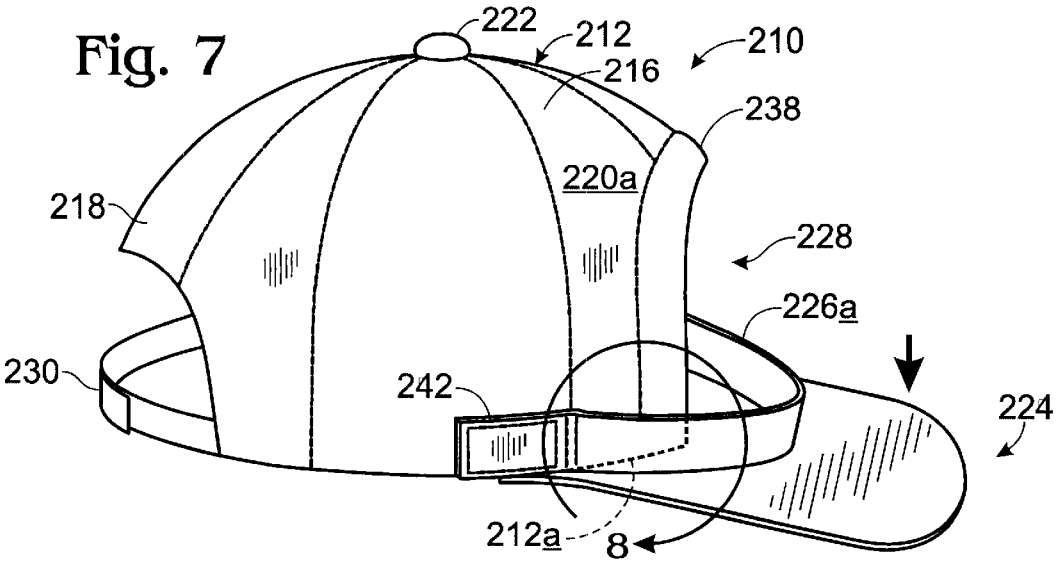
Figure 8:
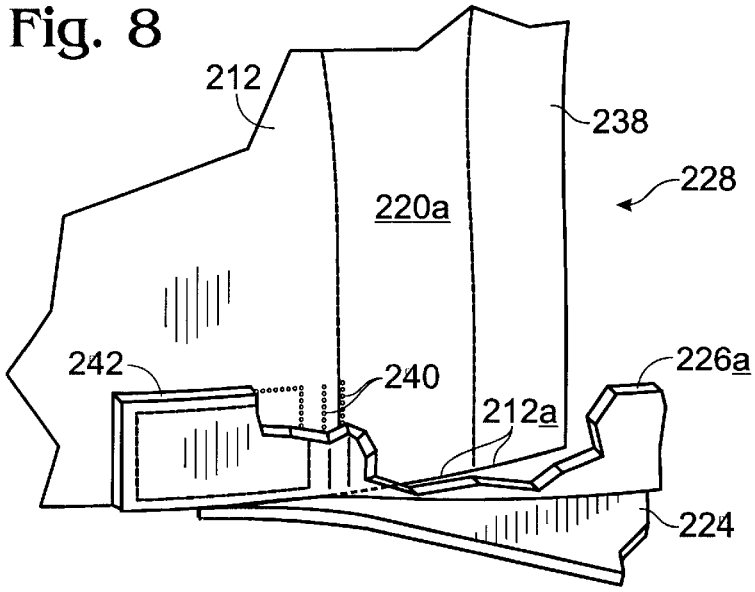
FIG. 8 is an enlarged, fragmentary section of the cap shown in FIG. 7.
Figure 9:
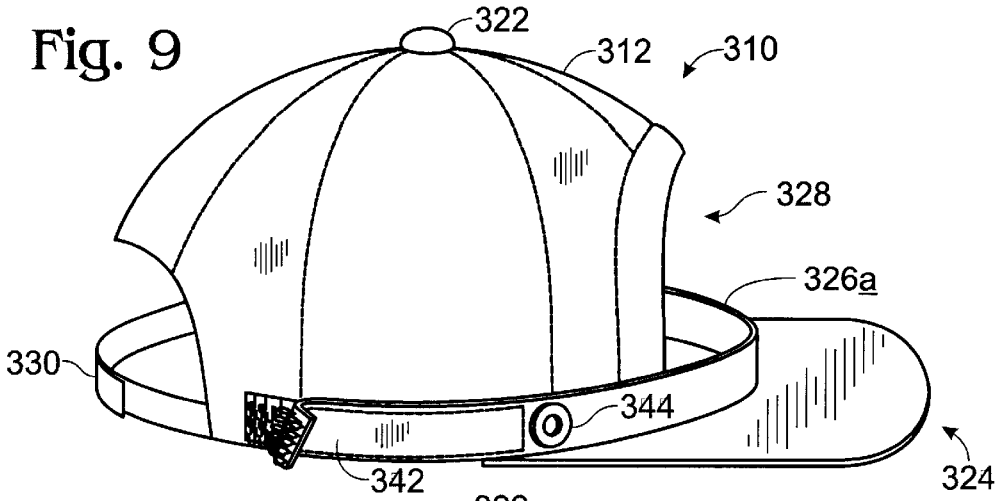
FIG. 9 is a side elevation showing a fourth embodiment of the cap of the present invention.
Figure 10:
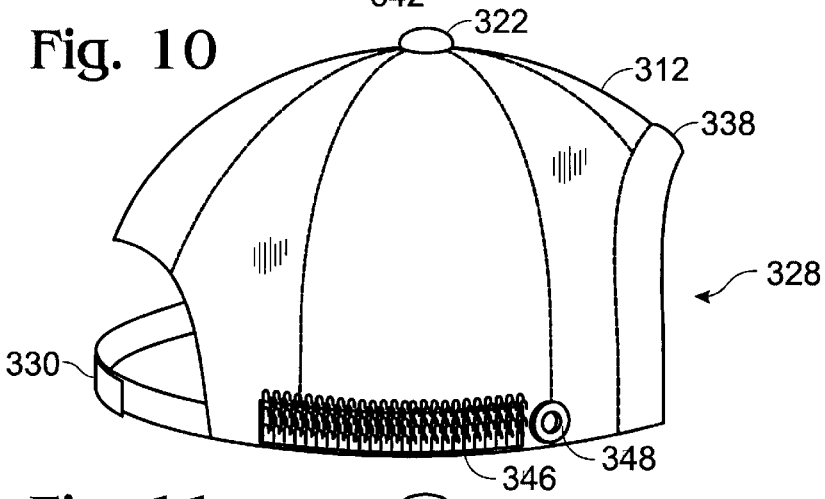
FIG. 10 is a side elevation showing only the head-covering section of the fourth embodiment of the cap of the present invention.

Referring to FIGS. 5–8, a third preferred embodiment of the invention is shown as hat 210 with crown 212 and brim 224. In this embodiment, brim 224 is suitably fastened to crown 212 as by stitching lip 226*a* to crown 212 at opposing regions of crown 212 that are rearward of opening 228. Referring to FIG. 7–8, there is a focus on one of those two regions (a right-side region). In that region, crown 212 is stitched to lip 226*a* of brim 224 at dual seams 240. By fastening the crown to the brim in this way, there is a region 212*a* of crown 212 that is unattached to brim 224. That unattached region allows for a certain amount of movement of the brim relative to the crown as shown by the two positions of brim 224 depicted in FIGS. 6–7. That movement advantageously provides for adjustment of the crown and opening when worn by a wearer as described further below. FIGS. 6 and 7 also show that a rearward strap section 242 of brim 224 may extend substantially rearward of opening 228 (FIG. 6) or only somewhat rearward of opening 228 (FIG. 7). At a minimum, strap section 242 must define an area that is large enough to provide an effective fastening region for brim 224 and crown 212.

Figure 11:
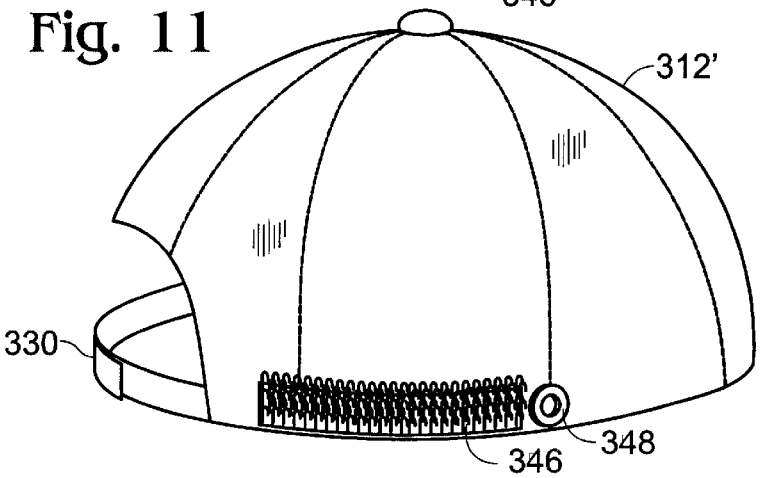
FIG. 11 is a side elevation showing an alternate version of the head-covering section of the fourth embodiment of the cap of the present invention.
Figure 12:
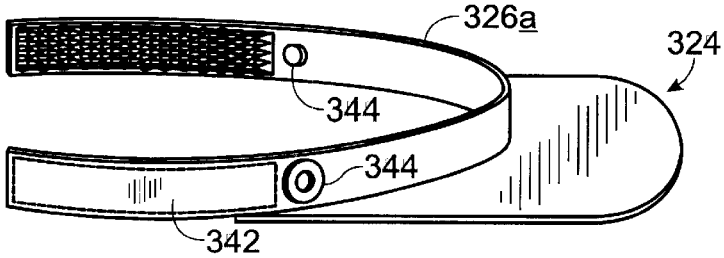
FIG. 12 is a side elevation showing only the visor section of the fourth embodiment of the cap of the present invention.

FIGS. 9–12 shows cap 310, a fourth preferred embodiment of the invention. Cap 310 includes crown 312 and brim 324 that removably attaches to crown 312 by a first fastener section 342 and a second fastener section 344. First fastener section 342 may be formed as a hook and loop fastener material such as that marketed under the trademark VELCRO, and second fastener section 344 may be formed as a snap. Corresponding first and second fastener sections of crown 312 are shown at 346, 348, respectively. Crown 312 may be formed with an opening 328 and reinforced border 338 (FIGS. 9–10) or without an opening 328' (FIG. 11). One of the functions of having brim 324 being removably fastenable to crown 312 is to allow for interchangeability of hats and crowns. For example, a wearer could choose one of several brims (undepicted) of various styles and colors, and match it with one of several crowns (undepicted) of various styles and colors. For professional sports teams, this interchangeability of brims and crowns would allow teams to select desired "home" and "away" crowns to be matched with the same brim.

In Operation

FIG. 3 shows cap 10 in place on the head of a wearer who is indicated in phantom lines. Cap 10 is placed on the head much like any baseball-style cap with one important difference. When placing cap 10 on the head, the wearer should ensure that their front bangs are allowed to extend through aperture 28 so that they are not mashed down by the front of the cap. In FIG. 3, the wearer's bangs may be seen to extend through aperture 28 adjacent brim 24. When cap 10 is on the head of a wearer, brim 24 is positioned for not only providing shade for the wearer's face and eyes, but deflecting an accumulation of hair extending from aperture 28. That is, because of the aperture's proximity to brim 24, the brim is positioned for contemporaneously providing shade for the wearer's face and eyes, as well as deflecting the wearer's hair from around their face and eyes.

This is important for a number of reasons. First, wearer's taking part in athletics such as golf and tennis usually do so outside where it may be sunny and bright. It is desirable when taking part in such activities, to have one's eyes and face shaded so that, for example, a golf shot or a tennis shot may be made, free from the distracting glare of the sun. Second, it is desirable when taking part in such activities, to do so without one's hair falling into one's face and providing a distraction. The present invention provides a cap which not only shades a wearer's eyes and face from the sun's distracting glare, but it also prevents a wearer's hair from interfering with their view. Furthermore, aperture 28 provides a ventilation port for keeping the front of a wearer's head cool when participating in outdoor activities on hot days. In addition, because the front bangs of the wearer are left substantially unencumbered, there is no crease left in the wearer's bangs when the hat is removed. Furthermore, the cap shades the top of the wearer's head from the sun while allowing the front part of the head to remain cool. This is most important when outdoor activities are undertaken during mid-day when the sun is most dangerous.

With that, it should be apparent that the above-described cap is useful in any setting where it is desirable to shade one's eyes or face from the sun and deflect one's bangs from adjacent one's face. Further, the cap is useful in settings where it is desirable to shade one's eyes or face from the sun and ventilate the front part of one's head to remain cool. Such settings may include recreational settings such as fishing and camping settings, or work settings where individuals are required to work outside for long periods of time, such as road or home construction. Needless to say, there are simply many settings and environments in which the above-described cap finds utility.

While the present invention has been shown and described with reference to the foregoing preferred embodiments, it is to be understood by those of skill in the art that other changes in form and detail may be made therein without departing from the spirit and scope of the invention as defined in the appended claims.

I claim:

1. A cap comprising:

a crown defining an opening for receiving a wearer's head, the crown including a front and being constructed to cover the wearer's head by making contact with at least a substantial part of the wearer's head;

an aperture formed in the front and constructed to allow an accumulation of a wearer's hair to extend therethrough;

a brim extending outward of the crown and having an edge which is joined to opposing regions of the crown rearward of the aperture, the brim defining, in part, the front of the cap;

hinge structure located on the crown rearward of the aperture, and constructed to allow the front of the crown to pivot relative to the brim, thereby allowing the wearer to adjust the position of the front of the crown and the aperture after placing the cap on their head; and wherein when the cap is on the wearer's head, the brim is capable of contemporaneously providing shade for the wearer's face and deflecting the hair extending through the aperture.

2. A cap comprising:

a crown defining an opening for receiving a wearer's head, the crown including a front and being constructed to cover the wearer's head by making contact with at least a substantial part of the wearer's head;

an aperture formed in the front and constructed to allow an accumulation of a wearer's hair to extend therethrough;

a brim extending outward of the crown and having an edge for joining to the crown, the brim defining, in part, the front of the cap;

brim-attachment/crown-adjustment structure that both attaches the brim to opposing regions of the crown rearward of the aperture and allows the position of the crown on the wearer's head to be adjusted relative to the brim so that the wearer can adjust the crown and aperture to a desired position on the wearer's head after placing the cap on their head; and wherein when the cap is on the wearer's head, the brim is capable of contemporaneously providing shade for the wearer's face and deflecting the hair extending through the aperture.

3. The cap of claim 2, wherein the brim-attachment/crown-adjustment structure takes the form of a hinge.

* * * * *